United States Patent [19]

Salemme et al.

[11] 4,019,832

[45] Apr. 26, 1977

[54] PLATFORM FOR A TURBOMACHINERY BLADE

[75] Inventors: Charles T. Salemme; Richard Ravenhall, both of Cincinnati; David J. Harris, Fairfield, all of Ohio

[73] Assignee: General Electric Company, Cincinnati, Ohio

[22] Filed: Feb. 27, 1976

[21] Appl. No.: 661,968

[52] U.S. Cl. ..... 416/135; 416/193 A; 416/239; 416/248; 416/219 R

[51] Int. Cl.[2] ..... B64C 11/06; F01D 7/00

[58] Field of Search ..... 416/190, 193 A, 131, 416/134, 135, 239, 248

[56] References Cited

UNITED STATES PATENTS

| | | | |
|---|---|---|---|
| 2,819,870 | 1/1958 | Wayne | 416/248 |
| 2,877,980 | 3/1959 | Stalker | 416/190 |
| 2,936,155 | 5/1960 | Howell et al. | 416/134 |
| 2,967,043 | 1/1961 | Dennis | 416/221 |
| 2,986,375 | 5/1961 | Stalker | 416/220 |
| 3,487,879 | 1/1970 | McCarthy et al. | 416/220 |
| 3,801,222 | 4/1974 | Violette | 416/220 |
| 3,810,711 | 5/1974 | Emmerson et al. | 416/193 A |
| 3,860,361 | 1/1975 | McMurtry et al. | 416/121 X |
| 3,905,722 | 9/1975 | Guy et al. | 416/193 A X |

FOREIGN PATENTS OR APPLICATIONS

| | | | |
|---|---|---|---|
| 1,083,235 | 1/1955 | France | 416/248 |
| 1,341,910 | 9/1963 | France | 416/193 A |

*Primary Examiner*—Everette A. Powell, Jr.
*Attorney, Agent, or Firm*—Robert C. Lampe, Jr.; Derek P. Lawrence

[57] ABSTRACT

A turbomachinery blade platform comprising a pair of complementary platform halves, each having an outer flow path defining shroud adapted to extend generally laterally of the blade. An inner flange on each platform half, also extending generally laterally of the blade, is retained in a cooperating slot formed within the support structure retaining the blade. A structural member extending between the shroud and the flange is contoured to conform to an overlapping wedging surface disposed about the blade airfoil surface. The platform is thus provided with redundant retention by both the blade and by the blade support structure.

10 Claims, 5 Drawing Figures

PLATFORM FOR A TURBOMACHINERY BLADE

BACKGROUND OF THE INVENTION

The present invention pertains to gas turbine rotor apparatus and, more particularly, to rotor blade platforms for use therein.

Rotor blades of dynamic machines, such as axial flow gas turbine engine compressors and fans, employ platforms which extend generally laterally of the blades to partially define the aerodynamic flow path between adjacent blades. Where the rotor blades are metallic and are retained by their roots in a rotatable hub, as by the well-known dovetail and slot arrangement, the platforms are often integrally formed as cantilevered elements on one or both sides of the blade airfoil portions. Adjacent blade platforms cooperate to define the aerodynamic flow path.

The current trend is toward incorporation of composite blades within gas turbine engines due to their inherent light weight, which makes them economically attractive. Composite blades are those blades formed by laminating multiple plies of elongated, small diameter filaments of high modulus of elasticity embedded in a lightweight matrix. Typical examples are the nonmetallic composites such as graphite filaments in an epoxy resin, and the metallic composites represented by boron filaments embedded in an aluminum matrix. The manner of lamination and filament orientation is well known in the art, though development is continuing. However, to date no practical configuration has been found by which blade platforms can be molded integrally with the blades during the blade lamination process. Accordingly, attention has been directed toward bonding a composite platform to the blade after the blade forming operation, an approach which has been generally unsuccessful for several reasons. First, complete bonding which is capable of withstanding delamination or separation under centrifugal loading is difficult to obtain. For example, in the case of a metallic composite, diffusion bonding of the platform and blade require pressures and temperatures of such magnitude that the relatively brittle filaments within the ply matrix can be crushed. Secondly, fastening by such conventional means as bolts and rivets is undesirable due to stress concentration at the holes and the fact that the holes necessarily sever the high-strength elongated filaments.

Accordingly, it becomes necessary to develop a platform for a composite blade which overcomes the aforementioned difficulties. Preferably, the platform configuration should be adaptable to blades of the increasingly popular variable pitch variety (i.e., those that are rotatable about their longitudinal axis). Furthermore, since composite blades and platforms are particularly susceptible to foreign object damage due to the relatively soft matrix materials and relatively brittle filament materials employed, it becomes desirable to provide a rotor apparatus wherein the blade or platform, or both, are easily replaceable.

SUMMARY OF THE INVENTION

An object of the present invention, therefore, is to provide a new and improved platform for blades of the composite variety.

A further object of the present invention is to provide a rotor apparatus for gas turbine engines and the like incorporating an improved blade platform.

These and other objects and advantages will be more clearly understood from the following detailed description, the drawings and specific examples, all of which are intended to be typical of rather than in any way limiting to the scope of the present invention. Briefly stated, the above objects are accomplished by providing a rotor blade platform which is split into essentially two complementary halves, each half including an outer flow path defining shroud adapted to extend generally laterally of the blade when assembled. An inner flange, generally parallel to the shroud is retained in a cooperating locking groove formed within the blade support structure. In the case of a variable pitch blade, a spindle is provided with a generally cylindrical recess in the top thereof and having the locking groove cut within the inner periphery, and at the base, thereof. The two generally semicircular platform halves are then inserted into the recess and spread apart to engage the flange within the locking groove. The blade is then inserted between the separated halves with the blade root (dovetail) engaged within a spindle dovetail slot in general alignment with the space between platform halves. The structural member of each platform half extending between the shroud and the flange includes a contoured edge which conforms to an overlapping wedging surface of a composite band disposed upon the blade. Thus, the platform is provided with redundant retention capability without the necessity of bonding the platform to the blade or spindle, and without destroying the structural integrity of any component by forming holes therethrough.

DESCRIPTION OF THE DRAWINGS

While the specification concludes with claims particularly pointing out distinctly claiming the subject matter which is regarded as part of the present invention, it is believed that the invention will be more fully understood from the following description of the preferred embodiment which is given by way of example with the accompanying drawings in which:

DESCRIPTION OF THE PREFERRED EMBODIMENT

Figure 1:
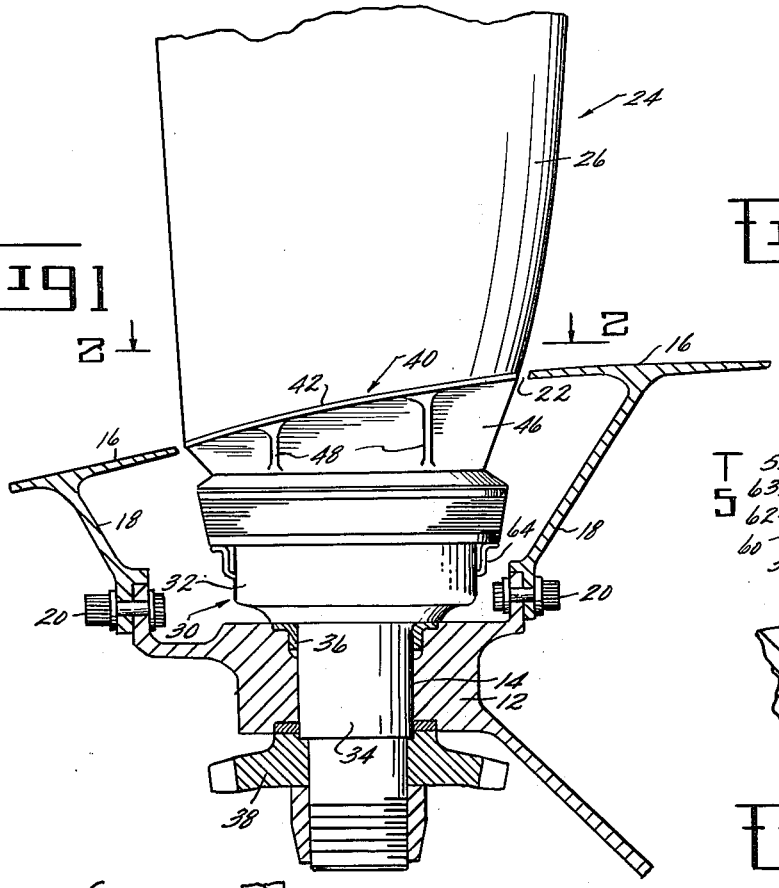
FIG. 1 is a view, in partial cross section, depicting a gas turbine engine variable pitch fan rotor assembly incorporating the subject invention.

Referring to the drawings wherein like numerals correspond to like elements throughout, attention is first directed to FIG. 1 wherein a gas turbine engine variable pitch fan rotor assembly depicted generally at 10 and embodying the present invention is shown. This assembly includes a fan disc 12 of generally circular periphery and rotatable about its axis, and provided with a plurality of apertures in its periphery, a typical aperture designated 14. While not so depicted, the apertures are generally circular in cross section. In addition, the disc carries a generally conical member 16 on its radially outer extremity by means of webs 18 and bolted connections 20, the conical member 16 contoured in a fashion appropriate for mating with a generally elliptical bullet nose, not shown. The conical member 16 is also provided with a plurality of apertures on its periphery, a typical aperture designated 22 and also of generally circular cross section, each aperture 22 cooperating with an aperture 14. The disc, thus described, is typical of that associated with the fan disposed within the inlet of a variable pitch gas turbofan engine.

Emanating from the disc 12 are a plurality of fan blades, only one of which is shown for clarity at 24. Each of the blades incorporates an airfoil portion 26 and a root portion 28 (FIGS. 3 and 4), the root being supported within a support member such as spindle 30 adapted to penetrate one of the apertures 22 in conical member 16 and cooperating aperture 14 in the disc. The spindle includes an enlarged, generally cylindrical portion 32 and a smaller, generally cylindrical portion 34 (FIG. 3) adapted to be rotatable within an aperture 14. In order to enhance this rotatable character, a bushing 36 (or, alternatively, a bearing not shown) is provided between the spindle 30 and the disc 12 to permit relative rotation therebetween.

In order to accomplish pivoting the blade spindle 30 and thus the airfoil 26 with respect to the disc, a pinion gear or gear sector 38 is disposed about the spindle and typically cooperates with the spindle by means of a mating spline, not shown. Each such blade has its own spindle and pinion gear for individual control of its own rotation. In order to accomplish rotation of the blades, a large ring gear (not shown) would be provided to interlock and mesh with each sector gear. Such a mechanism is taught and claimed in U.S. Pat. No. 3,873,235, Mendelson, which is assigned to the assignee of the present invention and the specification of which is incorporated herein by reference.

Spindle 30 is shown to include a contoured dovetail slot 50 broached therethrough in the generally axial direction, though a curved dovetail and slot would be equally appropriate as can be appreciated by those skilled in the art. Slot 50 is adapted to receive the blade root 28 in sliding relationship so as to provide blade retention and thereby impart rotational motion to the blade, as well as serving to entrap a blade platform within the rotor apparatus in a manner now to be described.

Referring now to FIGS. 2 through 5, it becomes apparent that each airfoil portion is provided with a blade platform 40 comprising a pair of complementary composite platform halves **40*a*, 40*b* essentially surrounding the blade to complete the aerodynamic flow path partially defined by conical member 16. It is expected that platform halves 40*a*, 40*b* are comprised of laminated composite plies such as graphite filaments in an epoxy matrix or boron filaments in an aluminum matrix, or other suitable composite materials. Each platform half includes an outer flow path defining shroud 42 of generally semicircular periphery adapted to cover aperture 22. An inner flange 44, also adapted to extend generally laterally of the blade and substantially parallel to shroud 42, provides a means for entrapping the platform in the spindle. The structural member 46 of each platform half extending between the shroud and the flange includes a substantially straight edge 47 which, when the platform is assembled, is substantially parallel to dovetail slot 50 for reasons to become apparent. Webs 48 provide structural reinforcement of the shroud 42**.

A band 56 of composite material such as epoxy resin is molded around the airfoil portion 46 and subsequently machined with straight sides to conform to platform edge 47. Additionally, a pair of inwardly facing locking surfaces 58 are machined in the form of wedges. The width, *w*, of the band is only such as is necessary to transist the high camber of the blade into a substantially rectangular profile. Thus, band 56 comprises, in essence, a miniplatform.

Figure 4:
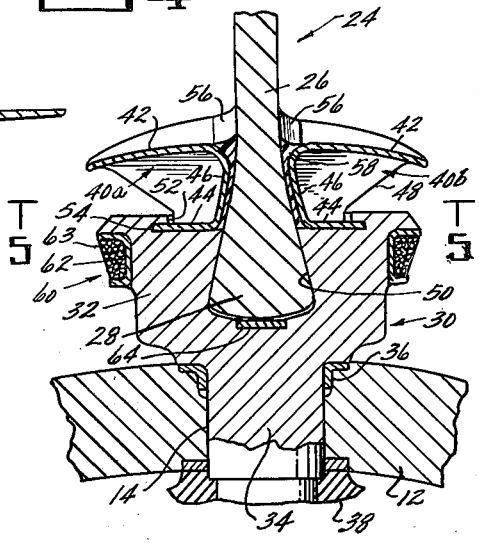
FIG. 4 is a cross-sectional view of the rotor assembly of FIG. 1 depicting the platform in its assembled configuration.
Figure 2:
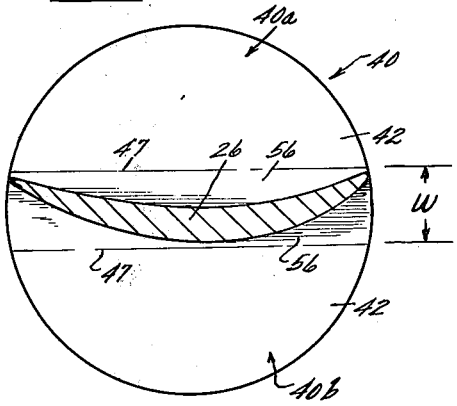
FIG. 2 is a plan-form view taken along line 2—2 of FIG. 1 and depicting the rotor blade platform in its assembled configuration surrounding the rotor blade.
Figure 3:
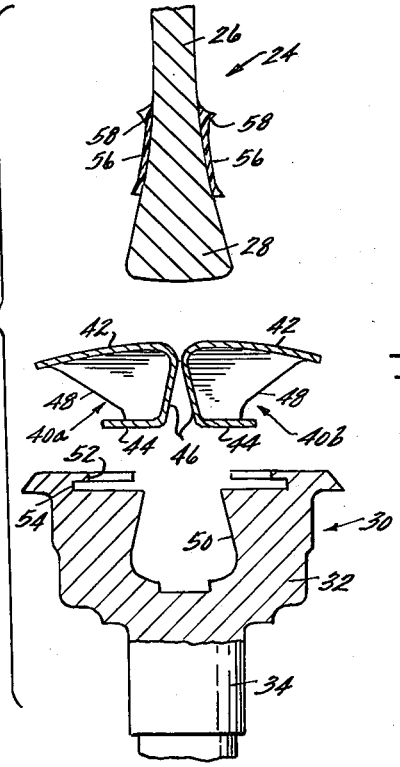
FIG. 3 is an exploded view, in cross section, of the rotor assembly of FIG. 1.
Figure 5:
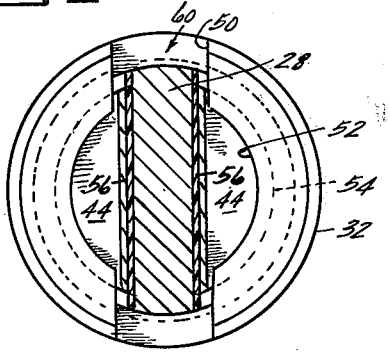
FIG. 5 is a cross-sectional view taken along line 5—5 of FIG. 4 depicting in greater detail the blade and dovetail assembly.

Each spindle is provided with an aperture 52 of circular profile at the top thereof in overlaying relationship to slot 50, the aperture being coaxial with the spindle rotational axis and broached by the dovetail slot 50. A generally circular locking groove 54 of a radius conforming generally to that of flange 44 provides a step diameter for retaining the platform halves when inserted therebetween. Note that the projected width of flanges 44 is less than the diameter of aperture 52 as indicated in FIG. 3. Accordingly, the halves may be inserted within the aperture and spread such that flanges 44 engage groove 54 as shown in FIG. 4, members 46 thus defining a radial continuation of dovetail slot 50. With the platform halves properly oriented, the slot continuation will be of a width sufficient to receive the blade at the location of band 56. When the blade is inserted between the halves and within the dovetail slot 50, the halves are restrained from moving with respect to each other and from moving radially outwardly under centrifugal loads since the flanges 44 are entrapped between the blade root and spindle 30.

Additional and redundant radial restraint is provided by means of band 56 since the wedge-shaped locking surfaces 58 are adapted to overlap the platform halves at the junction of members 46 with their respective shrouds. Thus, when the blades are inserted within slot 50, surfaces 58 project partially over the platform halves. As previously noted, band 56 is typically a composite matrix material such as graphite, epoxy which, besides providing the retention as discussed, also serves as a wear band between the platform halves and the blade. In its construction, the band entirely separates these elements and provides a contoured "bushing" therebetween as depicted in FIG. 3. While the preferred embodiment contemplates molding the band onto the blade prior to inserting the blade between the platform halves, it is within the scope of the present invention to assemble the rotor assembly without the band and subsequently inject a liquid or plastic composite material which is thereafter cured to form band 56, particularly where blade cambers are low. It is also within the scope of this invention to form band 56 of a hard elastomeric material possessing high vibration damping characteristics.

While the blade platform halves are essentially locked in place by the insertion of the blade root 28 into dovetail slot 50 of spindle 30, the blade, in turn, is locked within the spindle by means of a generally cylindrical locking collar 60 which slides over cylindrical portion 30 and which overlaps the ends of blade root 28 to prevent displacement thereof with respect to the spindle. As most clearly depicted in FIGS. 4 and 5, the locking collar is of U-shaped cross section having a channel 62 extending about the outer periphery thereof. It has been found that under extreme centrifugal loading, some spindles have a tendency to separate laterally due to the inherent weakness caused by the dovetail slot 50. This tendency can be arrested by winding high strength, elongated composite filaments 63 such as boron filaments, around the spindle within the channel 62 to increase the collar hoop stiffness. Spring clip 64 merely retains collar 60 upon cylindrical portion 32 when centrifugal forces are inadequate. This clip may be cylindrical and surround the spindle portion 32 or, as shown in FIGS. 1 and 4, comprise a metallic strip inserted between the blade root and spindle with ends bent and formed to engage collar 60.

It should become obvious to one skilled in the art that certain changes can be made to the above-described invention without departing from the broad inventive concepts thereof. For example, it is contemplated that the above invention is equally applicable to constant-pitch rotor systems wherein the rotor blades are mounted upon a rotatable disc and retained by dovetail slots broached axially upon the periphery thereof. It would be an obvious extension of the present invention to machine locking grooves equivalent to locking grooves 52 about the periphery of the disc. Also, while the present invention is directed toward composite blades and platforms, it is equally applicable to metallic structures in certain selected applications. It is intended that the appended claims cover these and all other variations in the present invention's broader inventive concepts.

Having thus described the invention, what is considered novel and desired to be secured by Letters Patent of the United States is:

1. A blade platform for providing an aerodynamic flow path around a blade, the platform comprising a pair of complementary elements, each having an outer flow path defining shroud adapted to extend generally laterally of a blade when assembled therewith; an inner flange also adapted to extend generally laterally of the blade and to be received by a locking groove formed within a blade support means for limiting outward displacement of the platform; and a contoured member extending between the flow path defining shroud and the flange having a surface conforming to an overlapping wedge retaining means disposed upon the blade for further limiting outward displacement of the platform.

2. A rotor apparatus comprising:

a blade having a root portion and an airfoil portion;

means for supporting said blade;

a blade platform for providing an aerodynamic flow path around the blade, the platform comprising a pair of complementary elements, each having an outer flow path defining shroud extending generally laterally of the blade, an inner flange also extending generally laterally of the blade and into a cooperating locking groove formed within the blade supporting means to limit outward displacement of the platform, and a contoured member extending between the shroud and the flange having a surface generally conforming to an overlapping wedge retaining means disposed upon the blade airfoil portion for further limiting outward displacement of the platform.

3. The rotor apparatus as recited in claim 2 wherein said platform is provided with a generally circular periphery, each of the pair of complementary elements being generally semicircular in profile.

4. The rotor apparatus as recited in claim 2 wherein:

the blade supporting means comprises a generally cylindrical spindle including a transverse slot in one end thereof to receive the blade root in sliding relationship;

the locking groove is formed about the inner periphery of a substantially circular aperture formed within the spindle in overlaying relationship to the slot; and wherein the contoured surfaces of cooperating platform elements form a continuation of the dovetail slot when inserted within the locking groove.

5. The rotor apparatus as recited in claim 4 wherein said retaining means shrouds the blade with a substantially rectangular, laterally extending band.

6. The rotor apparatus as recited in claim 5 wherein said retaining means is provided with a wedge surface for mating in overlapping relationship with an adjacent platform element.

7. The rotor apparatus as recited in claim 2 further comprising collar means for surrounding said spindle and overlapping the ends of said blade root within the transverse slot to retain the blade root therein.

8. The rotor apparatus as recited in claim 7 wherein said collar means is substantially cylindrical and includes a channel extending about the outer periphery thereof, said channel receiving a high strength filament wound about the collar.

9. The rotor apparatus as recited in claim 2 wherein said platform is comprised of a nonmetallic composite material.

10. The rotor apparatus as recited in claim 2 wherein said platform is comprised of a metallic composite material.

* * * * *